US009284499B2

(12) United States Patent
Van Wees et al.

(10) Patent No.: US 9,284,499 B2
(45) Date of Patent: Mar. 15, 2016

(54) PROCESS AND APPARATUS FOR INTEGRATING SLURRY HYDROCRACKING AND DEASPHALTING

(75) Inventors: Mark Van Wees, Des Plaines, IL (US); Robert S. Haizmann, Rolling Meadows, IL (US); Daniel B. Gillis, Arlington Heights, IL (US)

(73) Assignee: UOP LLC, Des Plaines, IL (US)

( * ) Notice: Subject to any disclaimer, the term of this patent is extended or adjusted under 35 U.S.C. 154(b) by 1361 days.

(21) Appl. No.: 12/495,409

(22) Filed: Jun. 30, 2009

(65) Prior Publication Data

US 2010/0326883 A1 Dec. 30, 2010

(51) Int. Cl.

| | |
|---|---|
| ***C10C 3/08*** | (2006.01) |
| ***C10G 11/18*** | (2006.01) |
| ***C10G 47/00*** | (2006.01) |
| ***C10G 47/26*** | (2006.01) |
| ***C10G 67/04*** | (2006.01) |
| ***C10G 21/00*** | (2006.01) |
| ***C10G 65/14*** | (2006.01) |
| ***C10G 67/00*** | (2006.01) |

(52) U.S. Cl.
CPC ..... *C10G 67/04* (2013.01); *C10G 21/003* (2013.01); *C10G 65/14* (2013.01); *C10G 67/00* (2013.01)

(58) Field of Classification Search
None
See application file for complete search history.

(56) References Cited

U.S. PATENT DOCUMENTS

| | | | | |
|---|---|---|---|---|
| 2,303,023 | A * | 11/1942 | Cier | 208/45 |
| 2,973,313 | A * | 2/1961 | Pevere et al. | 208/86 |
| 2,975,121 | A * | 3/1961 | Whaley | 208/251 R |
| 3,161,585 | A * | 12/1964 | Gleim et al. | 208/264 |
| 4,313,818 | A * | 2/1982 | Aldridge et al. | 208/112 |
| 4,435,275 | A * | 3/1984 | Derr et al. | 208/111.1 |
| 4,750,985 | A * | 6/1988 | Aldridge et al. | 208/112 |
| 5,474,977 | A | 12/1995 | Gatsis | |
| 5,755,955 | A | 5/1998 | Benham et al. | |
| 5,914,010 | A | 6/1999 | Hood et al. | |
| 7,279,090 | B2 | 10/2007 | Colyar et al. | |
| 2006/0157385 | A1 | 7/2006 | Montanari et al. | |
| 2006/0163115 | A1 | 7/2006 | Montanari et al. | |
| 2006/0186021 | A1 | 8/2006 | Marchionna et al. | |
| 2008/0149534 | A1 | 6/2008 | Gautier et al. | |

FOREIGN PATENT DOCUMENTS

WO WO 2004/058922 A1 7/2004

OTHER PUBLICATIONS

U.S. Appl. No. 12/495,543, filed Jun. 30, 2009, VanWees et al.
Pillon, Interfacial Properties of Petroleum Products, 2007, CRC Press, Taylor & Francis Group, Boca Raton, Florida, pp. 173-181.

* cited by examiner

*Primary Examiner* — Randy Boyer
(74) *Attorney, Agent, or Firm* — James C. Paschall

(57) ABSTRACT

Solvent deasphalting (SDA) is used to prepare a heavy hydrocarbon feed for further upgrading. An overhead deasphalted oil (DAO) stream is prepared for catalytic upgrading and an asphaltene stream is prepared for slurry hydrocracking (SHC). SHC product can be further deasphalted and the DAO can be separated from solvent in an upstream extraction column.

16 Claims, 2 Drawing Sheets

PROCESS AND APPARATUS FOR INTEGRATING SLURRY HYDROCRACKING AND DEASPHALTING

FIELD OF THE INVENTION

The present invention relates to a process and apparatus for preparing hydrocarbon feed for slurry hydrocracking (SHC) and for processing SHC product using deasphalting.

DESCRIPTION OF RELATED ART

As the reserves of conventional crude oils decline, heavy oils must be upgraded to meet demands. In this upgrading, the heavier materials are converted to lighter fractions and most of the sulfur, nitrogen and metals must be removed. Crude oil is typically first processed in an atmospheric crude distillation tower to provide fuel products including naphtha, kerosene and diesel. The atmospheric crude distillation tower bottoms stream is typically taken to a vacuum distillation tower to obtain vacuum gas oil (VGO) that can be feedstock for an FCC unit or other uses. VGO typically boils in a range between at or about 300° C. (572° F.) and at or about 538° C. (1000° F.).

Solvent deasphalting (SDA) generally refers to refinery processes that upgrade hydrocarbon fractions using extraction in the presence of a solvent. The hydrocarbon fractions are often obtained from the distillation of crude oil, and include hydrocarbon residues or resids or gas oils from atmospheric column or vacuum column distillation. SDA permits practical recovery of heavier oil, at relatively low temperatures, without cracking or degradation of heavy hydrocarbons. SDA separates hydrocarbons according to their solubility in a liquid solvent, as opposed to volatility in distillation. Lower molecular weight and most paraffinic components are preferentially extracted. The least soluble materials are high molecular weight and most aromatic components. This makes the deasphalted oil (DAO) extract light and paraffinic, and the asphalt raffinate heavy and aromatic. Suitable solvents for SDA include propane and higher molecular weight paraffins, such as butane and pentane, for example. The DAO generally contains metal compounds as well as high molecular weight hydrocarbons.

Like SDA, SHC is also used for the primary upgrading of heavy hydrocarbon feedstocks including those mentioned above. In SHC, these liquid feedstocks are mixed with hydrogen and solid catalyst particles, e.g., as a particulate metallic compound such as a metal sulfide, to provide a slurry phase. Representative SHC processes are described, for example, in U.S. Pat. Nos. 5,755,955 and 5,474,977. SHC produces naphtha, diesel, gas oil such as VGO, and a low-value, refractory pitch stream. The VGO streams are typically further refined in catalytic hydrocracking or fluid catalytic cracking (FCC) to provide saleable products. To prevent excessive coking in the SHC reactor, heavy VGO (HVGO) is typically recycled to the SHC reactor. Typically, a vacuum column is required to separate VGO from pitch downstream from the SHC reactor with large operating expenses.

Secondary upgrading processes include catalytic hydroprocessing such as hydrotreating or hydrocracking and fluid catalytic cracking (FCC). Catalytic hydrotreating is generally accomplished by contacting the gas oil or other feedstock with a fixed bed of suitable catalytic hydrotreating catalyst in a catalytic hydrotreating reactor under conditions of elevated temperature and moderate pressure in the presence of hydrogen so as to convert hydrocarbons with heteroatoms to hydrogen heteroatom analogs and to convert unsaturated hydrocarbons to paraffins. Catalytic hydrocracking is generally accomplished by contacting the gas oil or other feedstock with a fixed bed of suitable catalytic hydrocracking catalyst in a catalytic hydrocracking reactor under conditions of elevated temperature and pressure in the presence of hydrogen so as to yield a product containing a distribution of hydrocarbon products desired by the refiner. Conventional catalytic hydroprocessing does not typically involve a catalyst slurry but a fixed catalyst bed. The operating conditions and the hydroprocessing catalyst within a catalytic hydroprocessing reactor influence the yield of the catalytically hydroprocessed products.

Traditionally, the fresh feedstock for a catalytic hydrocracking process is first introduced into a hydrotreating reaction zone particularly suited for the removal of sulfur and nitrogen contaminants and subsequently introduced into a catalytic hydrocracking zone containing catalytic hydrocracking catalyst. In other cases, hydrotreating is not followed by hydrocracking or is followed by FCC depending on the needs of the refiner.

FCC technology, now more than 60 years old, has undergone continuous improvement and remains the predominant source of gasoline production in many refineries. This gasoline, as well as lighter products, is formed as the result of cracking heavier (i.e. higher molecular weight), less valuable hydrocarbon feed stocks such as gas oil. In its most general form, the FCC process comprises a reactor that is closely coupled with a regenerator, followed by downstream hydrocarbon product separation. Hydrocarbon feed contacts fluidized catalyst in the reactor to crack the hydrocarbons down to smaller molecular weight products. During this process, coke accumulates on the catalyst, which must be burned off in the regenerator. In some cases, FCC is preceded by hydrotreating to remove heteroatom hydrocarbons from the FCC feed.

Conversion of heavy oils is typically accomplished by primary upgrading by SHC and/or by secondary upgrading in fixed-bed hydroprocessing or FCC operations. Upgrading the saturated components in a fixed catalyst bed hydroprocessing zone or FCC zone and cracking multi-ring aromatic components in a SHC zone at elevated temperature may be optimal. However, since certain paraffinic components may have similar boiling points as corresponding aromatic components, it is not possible to completely separate these components by distillation. Consequently, some multi-ring aromatic components are directed to the fixed-bed hydroprocessing or FCC unit where they increase catalyst deactivation rates and some saturated compounds are directed to the SHC unit where they crack to lighter components reducing yield and increasing hydrogen consumption.

There is an ongoing need in the art for processes which can separate heavy hydrocarbons to provide paraffinic feed for fixed-bed catalytic hydroprocessing or FCC processes from multi-ring aromatics which are best processed in a SHC unit

SUMMARY OF THE INVENTION

We have found that SHC is suited well for multi-ring aromatic feed while catalytic upgrading such as fixed catalytic bed hydroprocessing and FCC are well suited for paraffinic feed. These components are best separated by solvent deasphalting.

In an exemplary embodiment, an apparatus of the present invention for converting heavy hydrocarbons to lighter hydrocarbons comprises a first extraction column for extracting a DAO stream in a feed stream of heavy hydrocarbons from an asphaltene stream. A secondary upgrading reactor in communication with an overhead of the first extraction column catalytically upgrades the DAO stream. A SHC reactor in communication with a bottoms of the first extraction column slurry hydrocracks the asphaltene stream, In an additional embodiment, a second extraction column in downstream communication with the SHC reactor further separates aromatics from paraffins in the SHC product.

In another exemplary embodiment, a process of the present invention for converting heavy hydrocarbons to lighter hydrocarbons comprises deasphalting a heavy hydrocarbon feed stream to extract a DAO stream containing a greater concentration of saturated compounds than in the feed stream and provide an asphaltene stream containing a greater concentration of aromatic compounds than in the feed stream. At least a portion of the DAO stream is catalytically upgraded in the presence of an upgrading catalyst to produce a catalytically upgraded product. At least a portion of the asphaltene stream is slurry hydrocracked in the presence of hydrogen over a slurried catalyst to produce a slurry hydrocracked product. In an additional embodiment, a SHC product stream recovered from the slurry hydrocracked product may be further deasphalted to separate aromatics from paraffins.

We have also found that light VGO (LVGO) from SHC contains substantial paraffins that are best suited for catalytic upgrading rather than recycling to the SHC reactor. However, heavy VGO (HVGO) contains substantial multi-ring aromatics that are helpful for mesophase control in SHC.

In another exemplary embodiment, an apparatus of the present invention comprises an apparatus for converting heavy hydrocarbons to lighter hydrocarbons comprising a SHC reactor for SHC a heavy hydrocarbon stream. A first extraction column in downstream communication with the SHC reactor extracts a first DAO stream in a slurry hydrocracked product stream from an asphaltene stream. A second extraction column in downstream communication with the first extraction column further extracts a second DAO stream. The SHC reactor is in downstream communication with the second extraction column.

In another exemplary embodiment, a process of the present invention comprises a process for converting heavy hydrocarbons to lighter hydrocarbons comprising SHC a heavy hydrocarbon stream. A product stream is recovered from the SHC step. The product stream is deasphalted to extract a first DAO stream containing a greater concentration of saturated compounds than in the product stream and provide a first asphaltene stream containing a greater concentration of aromatic compounds than in the product stream. The first DAO stream is further deasphalted to provide a second DAO stream and a second asphaltene stream.

This arrangement enables separation of LVGO from HVGO without a vacuum column. The HVGO in the SHC product stream is separated from paraffins therein and recycled back to the SHC reactor to control undesirable mesophase production. The LVGO can be forwarded to secondary upgrading in catalytic upgrading reactor such as a hydrotreating, hydrocracking and/or FCC unit. The arrangement also enables further separation of any SHC catalyst from paraffins in the SHC product that will be directed to the catalytic cracking zone to ensure minimal SHC catalyst will be directed to catalytic cracking. Additionally, separation of solvent from DAO in a single DAO stripper omits an additional DAO stripper to service the first extraction column.

These and other aspects and embodiments relating to the present invention are apparent from the following Detailed Description.

DEFINITIONS

As used herein, the term "communication" means that material flow is operatively permitted between enumerated components.

As used herein, the term "downstream communication" means that at least a portion of material flowing to the component in downstream communication may operatively flow from the component with which it communicates.

As used herein, the term "upstream communication" means that at least a portion of the material flowing from the component in upstream communication may operatively flow to the component with which it communicates.

As used herein, the term "a component-rich stream" means that the rich stream coming out of a separator vessel has a greater concentration of the component than the feed to the separator vessel.

As used herein, the term "a component-lean stream" means that the lean stream coming out of a separator vessel has a smaller concentration of the component than the feed to the separator vessel.

DETAILED DESCRIPTION

Embodiments of the invention relate to the use of SDA to prepare a heavy hydrocarbon feedstock for primary upgrading in a SHC operation and secondary upgrading in fixed-bed catalytic hydroprocessing or FCC. According to one embodiment, for example, the heavy hydrocarbon feedstock comprises a vacuum column residue. Representative further components of the heavy hydrocarbon feedstock include residual oils such as an atmospheric residuum or a crude oil vacuum distillation column residuum boiling above 566° C. (1050° F.), tars, bitumen, coal oils, and shale oils. Bitumen is natural asphalt, tar sands and oil sands, and has been defined as rock containing hydrocarbons more viscous than 10,000 cp or else hydrocarbons that may be extracted from mined or quarried rock. Other natural bitumens are solids, such as gilsonite, grahamite, and ozokerite, which are distinguished by streak, fusibility, and solubility. Other asphaltene-containing materials such as whole or topped petroleum crude oils including heavy crude oils may also be used as components processed by SHC. In addition to asphaltenes, these further possible components of the heavy hydrocarbon feedstock, as well as others, generally also contain significant metallic contaminants, e.g., nickel, iron and vanadium, a high content of organic sulfur and nitrogen compounds, and a high Conradson carbon residue. The metals content of such components, for example, may be 100 ppm to 1,000 ppm by weight, the total sulfur content may range from 1% to 7% by weight, and the API gravity may range from about −5° to about 35°. The Conradson carbon residue of such components is generally at least about 5%, and is often from about 10% to about 30% by weight.

Figure 1:
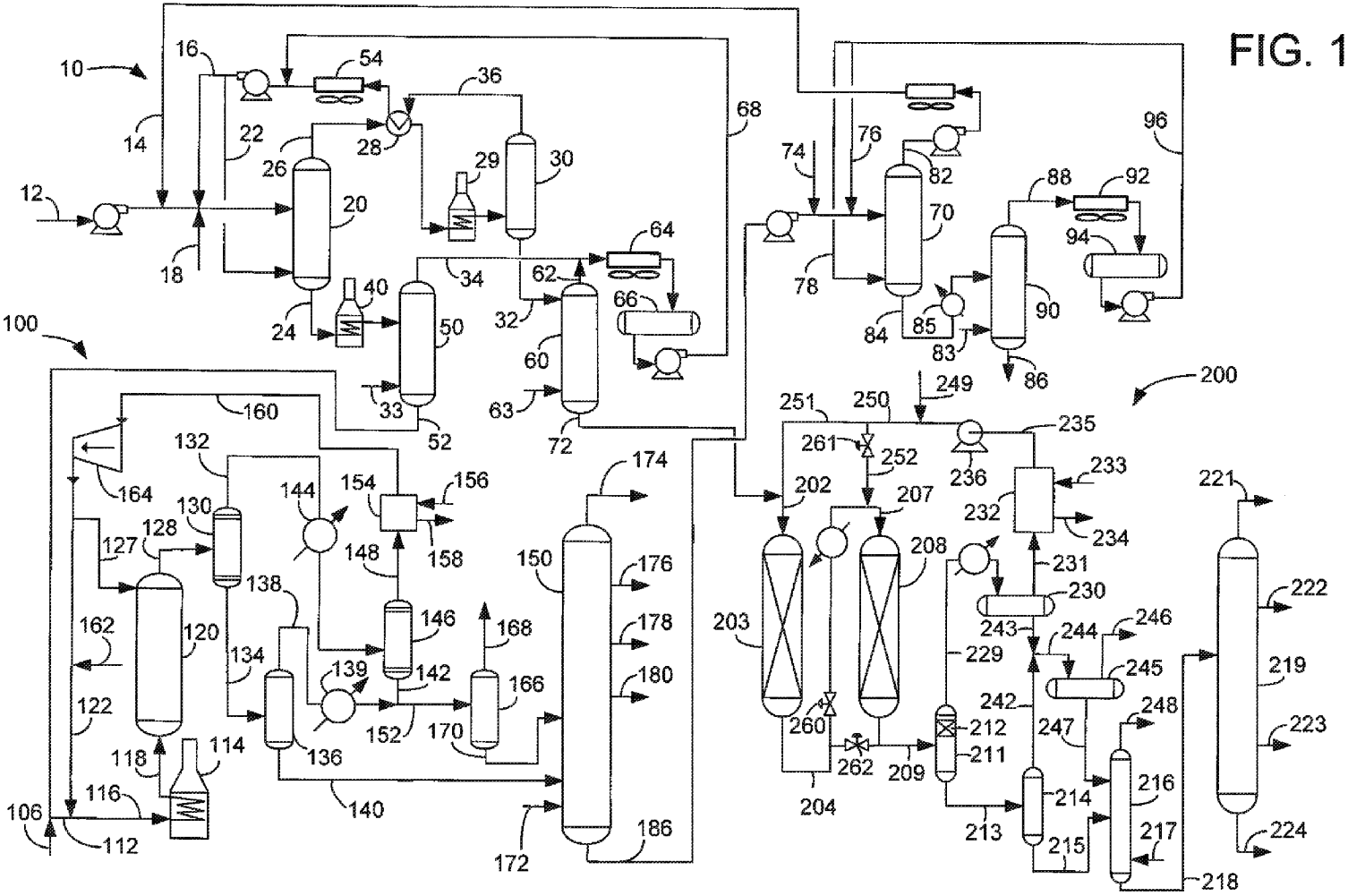
FIG. 1 is a schematic view of a process and apparatus of the present invention.
Figure 2:
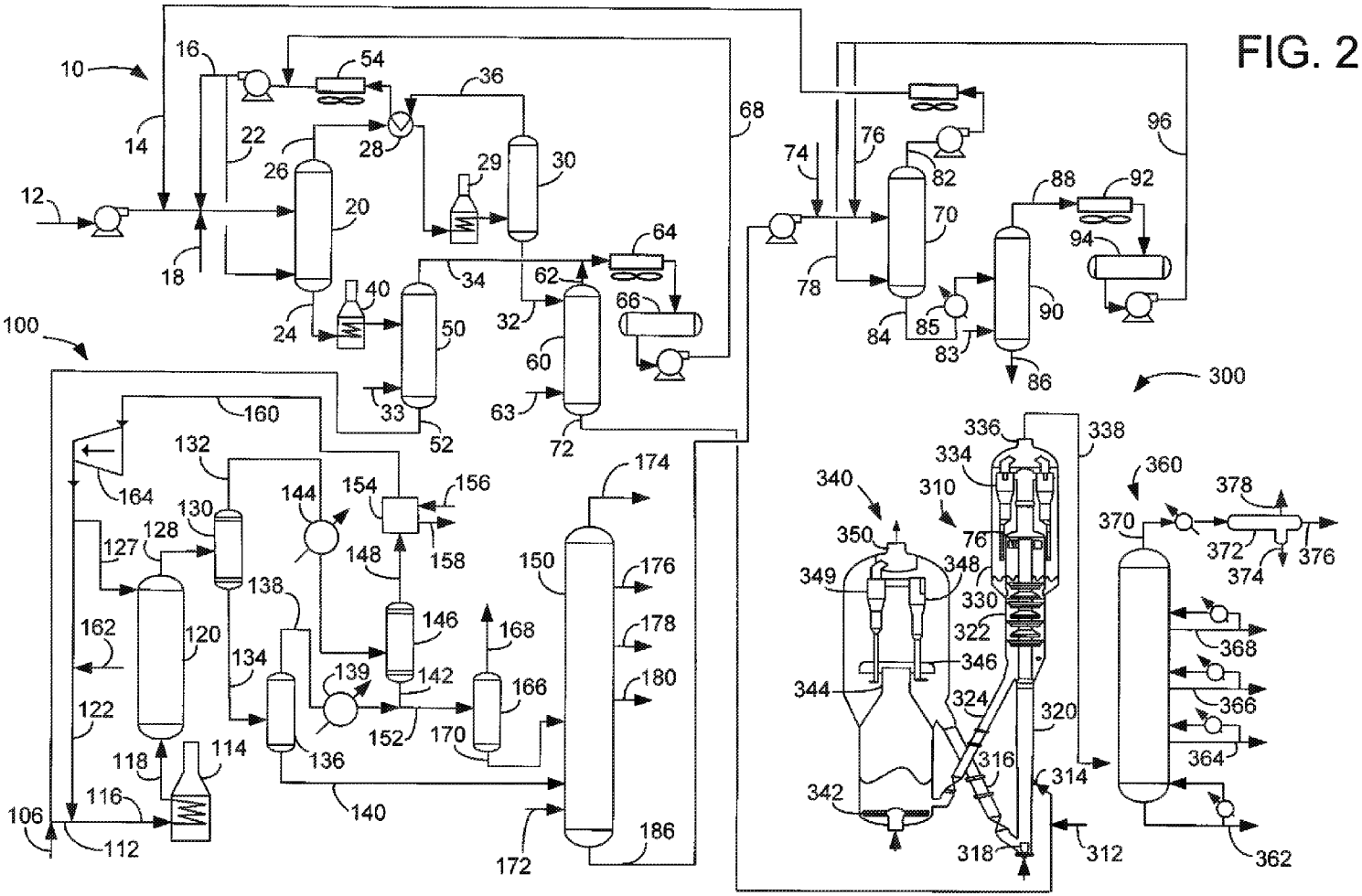
FIG. 2 is a schematic view of an alternative process and apparatus of the present invention.

As shown in FIGS. 1 and 2, the present invention for converting heavy hydrocarbons to lighter hydrocarbons is exemplified by a solvent deasphalting zone 10, a SHC zone 100 and a catalytic upgrading zone which may comprise a hydroprocessing zone 200 and/or an FCC zone 300.

A heavy hydrocarbon feed stream in line 12 may be transported to the solvent deasphalting zone 10. Alternatively, line 12 preferably carries a vacuum residue from a vacuum tower bottoms. In the SDA process, the heavy hydrocarbon feed stream in line 12 is pumped and admixed with a heavy hydrocarbon stream in line 14, a recycled solvent in line 16 and a make-up solvent in line 18 before entering into a first extraction column 20. In an additional embodiment, extraction column 20 may be a second extraction column in downstream communication with a first extraction column 70. Additional solvent, for example, recycled solvent, may be added to a lower end of the first extraction column 20 via line 22. The light paraffinic solvent, typically propane, butane, pentane or mixtures thereof solubilizes the heavy hydrocarbon material in the heavy hydrocarbon feed. N-pentane is a suitable solvent. The heavier aromatic portions of the feed are insoluble and precipitate out as an asphaltene or pitch stream in line 24 and a first DAO stream is extracted from the asphaltenes in feed stream 12. The first DAO stream exits the first extraction column 20 in an extractor raffinate line 26. The first extraction column 20 will typically operate at about 93° to about 204° C. (200° to 400° F.) and about 3.8 to about 5.6 MPa (550 to 850 psi). The first DAO stream in line 26 has a greater concentration of saturated compounds than in the feed stream in line 12. The first DAO stream is heated to supercritical temperature for the solvent by indirect heat exchange with heated solvent in the solvent recycle line 36 in heat exchanger 28 and in fired heater 29 or other additional heat exchanger. The supercritically heated solvent separates from the DAO in the DAO separator 30 which is in downstream communication with an overhead of the first extraction column 20. The DAO separator 30 may be a first separator in downstream communication with an overhead of the first extraction column 20. A solvent recycle stream exits the DAO separator 30 in the solvent recycle line 36. The solvent recycle stream is condensed by indirect heat exchange in heat exchanger 28 with the extractor raffinate in line 26 and condenser 54. The DAO separator 30 will typically operate at about 177° to about 287° C. (350° to 550° F.) and about 3.8 MPa to about 5.2 MPa (550 to 750 psi). The asphaltene stream in line 24 contains a greater concentration of aromatic compounds than in the feed in line 12. The asphaltene stream in line 24 is heated in fired heater 40 or by heat exchange and stripped in a pitch stripper 50 to yield a solvent-lean asphaltene stream in bottoms line 52 and a first solvent recovery stream in line 34. Steam from line 33 may be used as stripping fluid in the pitch stripper 50. The pitch stripper 50 will typically operate at about 204° to about 260° C. (400° to 500° F.) and about 344 kPa to about 1,034 kPa (50 to 150 psi). A solvent-lean DAO steam exits the DAO separator 30 in line 32 and enters DAO stripper 60 in downstream communication with a bottoms of the DAO separator 30. The DAO stripper 60 further separates a second solvent recovery stream from the DAO stream 62 by stripping DAO from the entrained solvent at low pressure. Steam from line 63 may be used as stripping fluid in the DAO stripper 60. The DAO stripper 60 will typically operate at about 149° to about 260° C. (300° to 500° F.) and about 344 kPa to about 1,034 kPa (50 to 150 psi). The second solvent recovery stream leaves in line 62 and joins the solvent in line 34 before being condensed by cooler 64 and stored in solvent reservoir 66. Recovered solvent is pumped from the reservoir 66 as necessary through line 68 to supplement the solvent in line 36 to facilitate extraction. Essentially solvent-free DAO is provided in line 72 and prepared for catalytic hydrocracking in catalytic hydrocracking zone 100.

As shown in FIG. 1, an SHC product stream in line 186 comprising pitch and VGO may be delivered to a second extraction column 70 of SDA apparatus 10. Although the SHC product stream in line 186 comprises heavily aromatic HVGO, it also contains substantially paraffinic LVGO which are optimally directed to catalytic hydrocracking. The SHC product also contains SHC catalyst which should be directed back to the SHC reactor 120. The second extraction column 70 is in downstream communication with an SHC reactor 120. In an additional embodiment, extraction column 70 may be a first extraction column 70 in upstream communication with the extraction column 20 being the second extraction column. The SHC product stream in line 186 may be pumped and admixed with a make up solvent in line 74 and/or a recovered solvent in line 76 before entering into the second extraction column 70. Additional solvent, for example, recovered solvent, may be added to a lower end of the second extraction column 70 via line 78. The light paraffinic solvent solubilizes the heavy hydrocarbon paraffinic material in the heavy hydrocarbon SHC product feed. The heavier portions of the SHC product comprising multi-ring aromatics and SHC catalyst are insoluble and precipitate out as pitch or asphaltenes in line 84. DAO comprising paraffins in the slurry hydrocracked product is extracted from the asphaltene stream. Again, N-pentane is a suitable solvent. A second DAO stream produced in overhead line 82 has a greater concentration of paraffins than in the SHC product stream 186. A second asphaltene stream is produced in bottoms line 84 that has a greater concentration of aromatics and SHC catalyst than in the SHC product stream 186. The second DAO stream in the extractor raffinate line 82 is pumped and cooled to become the hydrocarbon stream in line 14 recycled to the first extraction column 20 for further deasphalting. The DAO stream in line 14, comprising a portion of the SHC product stream in line 186, may be mixed with the heavy hydrocarbon feed in line 12 before undergoing extraction in the first extraction column 20. This arrangement enables further separation of any SHC catalyst from paraffins that will be directed to secondary upgrading such as in the catalytic hydroprocessing zone 200 to ensure minimal SHC catalyst will be directed to catalytic hydrocracking. Additionally, separation of solvent from DAO in line 82 can be performed in DAO stripper 30 omitting an additional DAO stripper to service extraction column 70. Lastly, the HVGO in the SHC product in line 186 is separated from paraffins therein and recycled back in line 52 to the SHC reactor 120 to control mesophase production.

The SHC reactor 120 and the overhead of the second extraction column 70 are in upstream communication with the first extraction column 20. In the embodiment in which the extraction column 70 is the first extraction column, the DAO stream in line 82 and 14 is a first DAO stream and the asphaltene stream in the bottoms line 84 is a first asphaltene stream. Moreover, in the alternative embodiment, the second extraction column 20 is in downstream communication with the first extraction column 70 and the SHC reactor 120 is in downstream communication with the second extraction column 20 via the bottoms lines 24 and 52. The second extraction column 70 will typically operate at about 93° to about 149° C. (200° to 300° F.) and about 3.8 to about 5.6 MPa (550 to 850 psi).

The asphaltenes or pitch in line 84 is heated in a fired heater or heat exchanger 85 and stripped in a second pitch stripper 90 in downstream communication with the second extraction column 70 to yield a pitch product stream in bottoms line 86 and solvent in overhead line 88. In the embodiment in which the extraction column 70 is the first extraction column, the pitch stripper 90 is a first pitch stripper 90. Steam from line 83 may be used as stripping fluid in the second pitch stripper 90. The second pitch stripper 90 will typically operate at about 232° to about 316° C. (450° to 600° F.) and about 344 to about 1,034 kPa (50 to 150 psi). The recovered solvent in line 88 is condensed by cooler 92 and stored in solvent reservoir 94. Recovered solvent is pumped from the reservoir 94 as necessary through line 96 to supply lines 76 and 78 with recovered solvent to facilitate extraction. Temperature ranges and pressures given for operation of the vessels will vary depending on conditions including the solvent used.

Typically, 20-70 wt-% of the heavy hydrocarbon feed is removed as DAO containing the lowest molecular weight and most paraffinic portion of the vacuum residue and is most suitable for secondary upgrading such as in catalytic hydroprocessing. The bottoms or asphaltene stream from the pitch stripper 50 contains a large portion of the contaminants such as Conradson carbon residue and metals and has high density between about 5 and about −10 API, and commonly between about 0 and about 10 API. This stream is also concentrated in polynuclear aromatics and is thus an excellent feedstock for upgrading by SHC.

The pitch or asphaltene stream in bottoms line 52 can be cracked optimally at the high temperature endemic in an SHC process. The bottoms of the pitch stripper 50 is in communication with a primary upgrading, SHC reactor 120 in SHC zone 100. The asphaltene stream in bottoms line 52 is presented as feed to the SHC zone 100 as shown in FIG. 1. A coke-inhibiting additive or catalyst of particulate material in line 106 is mixed together with the asphaltene stream in line 52 to form a homogenous slurry in line 112. Recycled HVGO from the SHC reactor 120 for mesophase control is already present in line 52. A variety of solid catalyst particles can be used as the particulate material. Particularly useful catalyst particles are those described in U.S. Pat. No. 4,963,247. Thus, the particles are typically ferrous sulfate having particle sizes less than 45 μm and with a major portion, i.e. at least 50% by weight, in an aspect, having particle sizes of less than 10 μm. Iron sulfate monohydrate is the preferred catalyst. Bauxite catalyst may also be preferred. In an aspect, 0.01 to 4.0 wt-% of coke-inhibiting catalyst particles based on fresh feedstock are added to the feed mixture. Oil soluble coke-inhibiting additives may be used alternatively or additionally. Oil soluble additives include metal naphthenate or metal octanoate, in the range of 50 to 1000 wppm based on fresh feedstock with molybdenum, tungsten, ruthenium, nickel, cobalt or iron.

This slurry of catalyst and heavy hydrocarbon feed in line 112 may be pumped and mixed with hydrogen in line 122 and transferred into a fired heater 114 via line 116. The combined feed is heated in the heater 114 flows through an inlet line 118 into an inlet in the bottom of the tubular SHC reactor 120 which is in downstream communication with the bottoms of the first extraction column 20. In the heater 114, iron-based catalyst particles newly added from line 106 typically thermally decompose to smaller ferrous sulfide which is catalytically active. Some of the decomposition will take place in the SHC reactor 120. For example, iron sulfate monohydrate will convert to ferrous sulfide and have a particle size less than 0.1 or even 0.01 μm upon leaving heater 114. The SHC reactor 120 may take the form of a three-phase, e.g., solid-liquid-gas, reactor without a stationary solid bed through which catalyst, hydrogen and oil feed are moving in a net upward motion with some degree of backmixing. Many other mixing and pumping arrangements may be suitable to deliver the feed, hydrogen and catalyst to the reactor 120.

The SHC reactor 120 can be operated at quite moderate pressure, in the range of 3.5 to 24 MPa, without coke formation in the SHC reactor 120. The reactor temperature is typically in the range of about 350° to about 600° C. with a temperature of about 400 to about 500° C. being preferred. The LHSV is typically below about 4 $h^{-1}$ on a fresh feed basis, with a range of about 0.1 to about 3 $hr^{-1}$ being preferred and a range of about 0.2 to about 1 $hr^{-1}$ being particularly preferred. The per-pass pitch conversion may be between about 50 and about 95 wt-%. The hydrogen feed rate is about 674 to about 3370 $Nm^3/m^3$ (4000 to about 20,000 SCF/bbl) oil. SHC is particularly well suited to a tubular reactor through which feed and gas move upwardly. Hence, the outlet from SHC reactor 120 is above the inlet. Although only one is shown in FIG. 1, one or more SHC reactors 120 may be utilized in parallel or in series. Because of the elevated gas velocities, foaming tends to occur in the SHC reactor 120. An antifoaming agent may also be added to the SHC reactor 120 to reduce the tendency to generate foam. Suitable antifoaming agents include silicones as disclosed in U.S. Pat. No. 4,969,988. Additionally, hydrogen quench from line 127 may be injected into the top of the SHC reactor 120 to cool the slurry hydrocracked product.

A slurry hydrocracked stream comprising a gas-liquid mixture is withdrawn from the top of the SHC reactor 120 through line 128. The slurry hydrocracked stream consists of several products including VGO and pitch that can be separated in a number of different ways. The slurry hydrocracked effluent from the top of the SHC reactor 120 is in an aspect, separated in a hot, high-pressure separator 130 kept at a separation temperature between about 200° and about 470° C. (392° and 878° F.), and in an aspect, at about the pressure of the SHC reaction. The optional quench in line 127 may assist in quenching the reaction products to the desired temperature in the hot high-pressure separator 130. In the hot high pressure separator 130, the effluent from the SHC reactor 120 in line 128 is separated into a gaseous stream 132 and a liquid stream 134. The gaseous stream is the flash vaporization product at the temperature and pressure of the hot high pressure separator. Likewise, the liquid stream is the flash liquid at the temperature and pressure of the hot high pressure separator 130. The gaseous stream is removed overhead from the hot high pressure separator 130 through line 132 while the liquid fraction is withdrawn at the bottom of the hot high pressure separator 130 through line 134.

The liquid fraction in line 134 is delivered to a hot flash drum 136 at about the same temperature as in the hot high pressure separator 130 but at a pressure of about 690 to about 3,447 kPa (100 to 500 psig). The vapor overhead in line 138 is cooled in cooler 139 and joins line 142 which is the liquid bottoms from a cold high pressure separator in line 142 to make line 152. A liquid fraction leaves the hot flash drum in line 140.

The overhead stream from the hot high pressure separator 130 in line 132 is cooled in one or more coolers represented by cooler 144 to a lower temperature. A water wash (not shown) on line 132 is typically used to wash out salts such as ammonium bisulfide or ammonium chloride. The water wash would remove almost all of the ammonia and some of the hydrogen sulfide from the stream 132. The stream 132 is transported to a cold high pressure separator 146. In an aspect, the cold high pressure separator is operated at lower temperature than the hot high pressure separator 130 but at about the same pressure. The cold high pressure separator 146 is kept at a separation temperature between about 10° and about 93° C. (50° and 200° F.) and at about the pressure of the SHC reactor 120. In the cold high pressure separator 146, the overhead of the hot high pressure separator 130 is separated into a gaseous stream 148 and a liquid stream 142. The gaseous stream is the flash vaporization fraction at the temperature and pressure of the cold high pressure separator 146. Likewise, the liquid stream is the flash liquid product at the temperature and pressure of the cold high pressure separator 146. By using this type of separator, the outlet gaseous stream obtained contains mostly hydrogen with some impurities such as hydrogen sulfide, ammonia and light hydrocarbon gases.

The hydrogen-rich stream in line 148 may be passed through a packed scrubbing tower 154 where it is scrubbed by means of a scrubbing liquid in line 156 to remove hydrogen sulfide and ammonia. The spent scrubbing liquid in line 158 may be regenerated and recycled and is usually an amine. The scrubbed hydrogen-rich stream emerges from the scrubber via line 160 and is recycled through recycle gas compressor 164 and line 122 back to the SHC reactor 120. The recycle hydrogen gas may be combined with fresh make-up hydrogen added through line 162.

The liquid fraction in line 142 carries liquid product to adjoin cooled hot flash drum overhead in line 138 leaving cooler 139 to produce line 152 which feeds a cold flash drum 166 at about the same temperature as in the cold high pressure separator 146 and a lower pressure of about 690 to about 3,447 kPa (100 to 500 psig) as in the hot flash drum 136. The overhead gas in line 168 may be a fuel gas comprising $C_4$— material that may be recovered and utilized. The liquid bottoms in line 170 from the cold flash drum 166 and the bottoms line 140 from the hot flash drum 136 each flow into the fractionation section 150.

The fractionation section 150 is in downstream communication with the SHC reactor 120. The fractionation section 150 may comprise one or several vessels although it is shown only as one vessel in FIG. 1. The fractionation section 150 may comprise a stripper vessel and an atmospheric column but in an aspect is just a single column. Inert gas such as medium pressure steam may be fed near the bottom of the fractionation section 150 in line 172 to strip lighter components from heavier components. The fractionation section 150 produces an overhead gas product in line 174, a naphtha product stream in side cut line 176, a kerosene product stream in side cut line 178 and a diesel product stream in side cut line 180. In an embodiment, all VGO and pitch goes out in bottoms line 186. The SHC product stream in bottoms line 186 will be heavily aromatic but contain substantial paraffins and SHC catalyst. Instead of recycling HVGO directly to the SHC reactor, the bottoms stream in line 186 is subjected to deasphalting to separate paraffins for secondary upgrading from aromatics for recycle to the SHC reactor 120.

Turning back to the SDA zone 10, the DAO stream in line 72 is contains substantial paraffins from the SHC product 186 and from feed 12. The highly paraffinic stream in line 72 well suited for secondary upgrading. The DAO stream in line 72 is therefore presented to a secondary upgrading unit. The catalytic upgrading reactor is in downstream communication with the overhead of the first extraction column 20 which may also be termed the second extraction column 20 under an alternative embodiment. In FIG. 1, the secondary upgrading unit is a fixed-bed catalytic hydroprocessing unit 200. DAO typically contains 50 wt-% or more material boiling at a temperature greater than 565° C. (1050° F.).

The catalytic hydroprocessing unit in FIG. 2 may include one or more hydroprocessing reactors such as a hydrotreating reactor 203 with or without a hydrocracking reactor 208. If a hydrocracking reactor 208 is included, it is preceded by hydrotreating reactor 203 to remove materials that deactivate the catalytic hydrocracking catalyst and to prepare the DAO feed for catalytic hydrocracking. Referring again to FIG. 2, the DAO stream in line 72 is admixed with a hydrogen-rich gaseous stream provided via line 251 and the resulting admixture is carried via line 202 and introduced into hydrotreating reactor 203. The catalytic hydrotreating reactor 203 is in downstream communication with the overhead of the first extraction column 20 which may also be termed the second extraction column 20 under an alternative embodiment. The hydrotreating reactor contains hydrotreating catalyst and is operated at hydrotreating conditions sufficient to reduce the level of metal compounds, sulfur and nitrogen compounds and saturate hydrocarbons. The hydrotreating reactor is preferably operated at a temperature from about 204° C. (400° F.) to about 482° C. (900° F.) and a pressure from about 3.5 MPa (500 psig) to about 20.8 MPa (3000 psig).

The term "hydrotreating" as used herein refers to processes wherein a hydrogen-containing treat gas is used in the presence of suitable catalysts in a fixed bed which are primarily active for the removal of heteroatoms, such as sulfur, nitrogen and metals and for some hydrogenation of aromatic compounds. Suitable hydrotreating catalysts for use in the present invention are any known conventional hydrogenation catalysts and include those which are comprised of at least one Group VIII metal, preferably iron, cobalt and nickel, more preferably cobalt and/or nickel, and at least one Group VIB metal, preferably molybdenum and tungsten, on a high surface area support material, preferably alumina. It is within the scope of the present invention that more than one type of hydrotreating catalyst may be used in the same hydrotreating reactor or vessel. The Group VIII metal is typically present in an amount ranging from about 2 to about 20 wt-%, preferably from about 4 to about 12 wt-%. The Group VIB metal will typically be present in an amount ranging from about 1 to about 25 wt-% preferably from about 2 to about 25 wt-%.

A resulting effluent from hydrotreating reactor 203 is carried via line 204. If the hydroprocessing unit 200 includes a hydrocracking reactor 208, the hydrotreated effluent in line 204 flows through open valve 260, is heated and optionally supplemented with hydrogen from line 252 flowing through open valve 261. If the hydrocracking reactor 208 is used, valve 262 is closed. Line 207 transports the catalytic hydrocracking feed to the catalytic hydrocracking reactor 208. The catalytic hydrocracking reactor 208 is in downstream communication with the overhead of the first extraction column 20 which may also be termed the second extraction column 20 under an alternative embodiment. The catalytic hydrocracking reactor may contain one or more fixed beds of the same or different catalysts.

In one embodiment, when the preferred products are middle distillates, the preferred catalytic hydrocracking catalysts utilize amorphous bases or low-level zeolite bases combined with one or more Group VIII or Group VIB metal hydrogenating components. In another embodiment when the preferred products are in the gasoline boiling range, the catalytic hydrocracking reactor contains a catalyst which comprises in general any crystalline zeolite cracking base upon which is deposited a minor portion of a Group VIII metal hydrogenating component. Additional hydrogenating components may be selected from Group VIB for incorporation with the zeolite base. The zeolite cracking bases are sometimes referred to in the art as molecular sieves and are usually composed of silica, alumina and one or more exchangeable cations, such as sodium, magnesium, calcium and rarer metals. They are further characterized by crystal pores of relatively uniform diameter between 4 and 14 Angstroms. It is preferred to employ zeolites having a relatively high silica to alumina mole ratio between about 3 and 12. Suitable zeolites found in nature include, for example, mordenite and faujasite. Suitable synthetic zeolites include, for example, the B, X, Y and L crystal types, for example, synthetic faujasite and mordenite. The preferred zeolites are those having crystal pore diameters between about 8-12 Angstroms, wherein the silica to alumina mole ratio is about 4 to 6. The zeolites which are preferably used for the base of catalytic hydrocracking catalysts in the present invention are readily commercially available.

The active metals employed in the preferred catalytic hydrocracking catalysts of the present invention as hydrogenation components are those of a Group VIII, i.e. iron, cobalt, nickel, ruthenium, rhodium, palladium, osmium, iridium and platinum. In addition to these metals, other promoters may also be employed in conjunction therewith, including the metals of Group VIB, e.g. molybdenum and tungsten. The amount of hydrogenating metal in the catalyst can vary within wide ranges. Broadly speaking, any amount between about 0.05% and 30% by weight may be used. In the case of the noble metals, it is normally preferred to use about 0.05 to about 2 wt-%. The preferred method for incorporating the hydrogenating metal is to contact the base material with an aqueous solution of a suitable compound of the desired metal wherein the metal is present in a cationic form. Following the addition of the selected hydrogenating metal or metals, the resulting catalyst powder is then filtered, dried, pelleted with added lubricants, binders or the like if desired, and calcined in air at a temperature of, for example, 371 to 648° C. (700° to 1200° F.) in order to activate the catalyst and decompose ammonium ions. Alternatively the base may first be pelleted followed by the addition of the hydrogenating component and activation by calcining. The foregoing catalysts may be employed in undiluted form or the powdered zeolite catalyst may be mixed and copelleted with other relatively less active catalysts, diluents or binders, such as alumina, silica gel, silica-alumina cogels, activated clays and the like, in proportions ranging between 5 and 90 wt-%. These diluents may be employed as such or they may contain a minor proportion of an added hydrogenated metal, such as Group VIB and/or Group VIII metal.

The catalytic hydrocracking is conducted in the presence of hydrogen and preferably at catalytic hydrocracking reactor conditions which include a temperature from about 204° C. (400° F.) to about 482° C. (900° F.) and a pressure from about 3.5 MPa (500 psig) to about 20.8 MPa (3000 psig). In addition, catalytic hydrocracking conditions may include a liquid hourly space velocity from about 0.1 to about 30 $hr^{-1}$ and a hydrogen circulation rate from about 337 normal $m^3/m^3$ (2,000 standard cubic feet per barrel) to about 4200 normal $m^3/m^3$ (25,000 standard cubic feet per barrel). The catalytic hydrocracking is conducted over a fixed catalyst bed and is typically down flow.

If hydrocracking is not part of catalytic upgrading, valves 260 and 261 may be closed and valve 262 opened, so the hydrotreated effluent from hydrotreating reactor 203 flows from line 204 to line 209 bypassing the hydrocracking reactor 208. A resulting effluent from catalytic hydrocracking reactor 208 or the catalytic hydrotreating reactor 203 is carried via line 209 into a first separator such as a hot vapor liquid separator 211 to provide a vaporous hydrocarbonaceous stream containing hydrogen, and a liquid hydrocarbonaceous stream. The vaporous hydrocarbonaceous stream from the hot vapor liquid separator 211 is, in one embodiment, passed through a bed 212 of hydrotreating catalyst positioned in the upper end of the hot vapor liquid separator 211 in order to further purify the vaporous hydrocarbonaceous stream in order to reduce the concentration of sulfur compounds. The vaporous hydrocarbonaceous stream is removed therefrom via line 229. The hot vapor liquid separator 211 is preferably operated at a pressure from about 3.5 MPa (500 psig) to about 20.8 MPa (3000 psig) and a temperature from about 204° C. (400° F.) to about 482° C. (900° F.). The hydrotreating catalyst contained in the hot vapor liquid separator may be selected from any of the hydrotreating catalysts described hereinabove or any other known hydrotreating catalysts.

The gaseous stream carried via line 229 is cooled and partially condensed by heat exchange means and the resulting cooled stream is introduced into cold vapor liquid separator 230. The cold vapor liquid separator is preferably operated at a pressure from about 3.5 MPa (500 psig) to about 20.8 MPa (3000 psig) and a temperature from about 15.6° C. (60° F.) to about 65° C. (150° F.).

A hydrogen-rich gaseous stream containing hydrogen sulfide is removed from cold vapor liquid separator 230 via line 231 and introduced into an absorber 232. The hydrogen-rich gaseous stream is scrubbed with a lean aqueous amine scrubbing solution, such as monoethanolamine, for example, introduced via line 233 into absorber 232 to remove at least a significant portion of the hydrogen sulfide contained therein. A rich aqueous amine absorption solution containing hydrogen sulfide is removed from the absorption zone 232 via line 234 and recovered. A hydrogen-rich gaseous stream having a reduced concentration of hydrogen sulfide is removed from absorption zone 232 via line 235 is compressed in a compressor 236 and admixed with a makeup hydrogen stream provided via line 249. The resulting admixture is carried in line 250. Makeup hydrogen may be introduced into the process at any convenient location to replace the hydrogen consumed in the hydrotreating reactor and the catalytic hydrocracking reactors. A hydrogen-rich gaseous stream is carried via line 251 to the hydrotreating reactor 203 and via line 252 through valve 261 to the catalytic hydrocracking reactor 208 if hydrocracking reactor 208 is utilized.

A liquid hydrocarbonaceous stream is removed from cold vapor liquid separator 230 and is carried via lines 243 and 244 and introduced into cold flash drum 245 to produce a vaporous stream containing hydrogen and normally gaseous hydrocarbon compounds in line 246 which is recovered. The cold flash drum is preferably operated at a temperature from about 32° C. (90° F.) to about 65° C. (150° F.) and a pressure from about 1.5 kPa (200 psig) to about 3.6 kPa (500 psig).

A liquid hydrocarbonaceous stream is removed from hot vapor liquid separator 211 via line 213 and introduced into hot flash drum 214 operated at a temperature from about 204° C. (400° F.) to about 482° C. (900° F.) and a pressure from about 1.5 kPa (200 psig) to about 3.6 kPa (500 psig). A vaporous hydrocarbonaceous stream is removed from hot flash drum 214 via line 242 and is carried via lines 242 and 244 and introduced into cold flash drum 245. A liquid hydrocarbonaceous stream is removed from hot flash drum 214 via line 215 and introduced into a stripper 216. A liquid hydrocarbonaceous stream is removed from cold flash drum 245 via line 247 and introduced into stripper 216. A gaseous stream containing normally gaseous hydrocarbons is removed from stripper 216 via line 248 and recovered. Stripping steam is provided to stripper 216 via line 217. A liquid hydrocarbonaceous stream is removed from stripper 216 via line 218 and introduced into fractionation zone 219 which may comprise one or more atmospheric columns. A naphtha hydrocarbon stream carried via line 221 and a kerosene stream carried via side-cut line 222 are removed from fractionation zone 219 and recovered. An ultra-low sulfur diesel stream is carried via side-cut line 223 and is removed from fractionation zone 219 and recovered. A liquid hydrocarbonaceous stream containing VGO is removed from fractionation zone 219 via line 224 and recovered. Some or all of VGO in line 224 may be recycled to the hydrocracking reactor 208. Alternatively, the hydrotreated VGO stream in line 224 of FIG. 2 may serve as the feed to an FCC unit 300. In this alternative case, the hydrocracking reactor 208 may or may not be used.

In an alternative embodiment, the paraffinic DAO stream in line 72 from the SDA zone 10 may be processed in a secondary upgrading reactor which is the FCC unit 300 shown in FIG. 2. In FIG. 2, everything is the same as in FIG. 1 with the exception of the secondary upgrading unit being an FCC unit 300 instead of the fixed-bed catalytic hydroprocessing unit 200.

The FCC unit 300 includes a reactor 310 and a catalyst regenerator 340. Suitable catalysts are those typically used in the art of fluid catalytic cracking, such as an active amorphous clay-type catalyst and/or a high activity, crystalline molecular sieves. Molecular sieve catalysts are preferred over amorphous catalysts because of their much-improved selectivity to desired products. Zeolites are the most commonly used molecular sieves in FCC processes. A large pore zeolite, such as a Y-type zeolite, bound on an active alumina material is preferred. Process variables typically include a cracking reaction temperature of about 400 to about 600° C. and a catalyst regeneration temperature of about 500 to about 900° C. Both the cracking and regeneration occur at an absolute pressure below about 0.5 MPa. The DAO stream in line 72 and/or other FCC feed in line 312, such as from line 224 in FIG. 1, are distributed by distributor 314 and contacted with a stream of fluidized, newly regenerated hot cracking catalyst entering from a regenerated catalyst standpipe 316. This contacting may occur in a narrow reactor riser 320, extending upwardly to the bottom of a reactor vessel 330. The even contacting of feed and catalyst may be assisted by gas such as steam from a fluidizing gas distributor 318. Heat from the regenerated catalyst vaporizes the feed and is thereafter cracked to lighter molecular weight hydrocarbons in the presence of the catalyst as both are transferred up the reactor riser 320 into the reactor vessel 330. The cracked light hydrocarbon products are thereafter separated from the cracking catalyst using cyclonic separators which may include a primary separator 332 and one or two stages of cyclones 334 in the reactor vessel 330. Product gases exit the reactor vessel 330 through a product outlet 336 to line 338 for transport to a downstream FCC main fractionation column 360. Inevitable side reactions occur in the reactor riser 330 leaving coke deposits on the catalyst that lower catalyst activity. The spent or coked catalyst requires regeneration for further use. Coked catalyst, after separation from the gaseous product hydrocarbon, falls into a stripping section 322 where steam or other inert gas is injected through a nozzle to counter-currently purge any residual hydrocarbon vapor from the coked catalyst. After the stripping operation, the coked catalyst is fed to the catalyst regenerator 340 through a spent catalyst standpipe 324.

FIG. 2 depicts a regenerator 340 of the type known as a combustor. However, other types of regenerators are suitable. In the catalyst regenerator 340, a stream of oxygen-containing gas, such as air, is introduced through an air distributor 342 to contact the coked catalyst, burn coke deposited thereon, and provide regenerated catalyst and flue gas. The catalyst regeneration process adds a substantial amount of heat to the catalyst, providing energy to offset the endothermic cracking reactions occurring in the reactor riser 320. Catalyst and air flow upwardly together along a combustor riser 344 located within the catalyst regenerator 340 and, after regeneration, are initially separated by discharge through a disengager 346. Finer separation of the regenerated catalyst and flue gas exiting the disengager 346 is achieved using first and second stage separator cyclones 348 and 349, respectively, within the catalyst regenerator 340. Catalyst separated from flue gas dispenses through respective diplegs from cyclones 348, 349 while flue gas relatively lighter in catalyst sequentially exits cyclones 348, 349 and exits the regenerator vessel 340 through flue gas outlet 350. Regenerated catalyst is recycled back to the reactor riser 320 through the regenerated catalyst standpipe 316. As a result of the coke burning, the flue gas vapors exiting at the top of the catalyst regenerator 340 through outlet 350 contain CO, $CO_2$ and $H_2O$, along with smaller amounts of other species.

The gaseous FCC product in line 338 is directed to a lower section of an FCC main fractionation column 360. Several product fractions may be separated and recovered from the main column including a main column bottoms in line 362, a heavy cycle oil stream in line 364, a light cycle oil in line 366 and a heavy naphtha or gasoline stream in line 368. Any or all of lines 362, 364, 366 or 368 may be cooled and pumped back to the main column 360 to cool the main column typically at a higher location. Gasoline and gaseous light hydrocarbons are removed in overhead line 370 from the main column 360 and condensed before entering a main column receiver 372. A condensed water stream 374 is removed from a boot in the receiver 372. Moreover, a condensed light naphtha or gasoline stream is removed in line 376 while a gaseous light hydrocarbon stream is removed in line 378. Both streams in lines 376 and 378 may enter a gas concentration section to separate and recover debutanized gasoline and lighter products. The main column bottom stream in line 362 typically boils at or above about 343° C. (650° F.).

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for converting heavy hydrocarbons to lighter hydrocarbons comprising:

a) deasphalting a heavy hydrocarbon feed stream to extract a DAO stream containing a greater concentration of saturated compounds than in the feed stream and provide an asphaltene stream containing a greater concentration of aromatic compounds than in the feed stream;

b) catalytically upgrading at least a portion of the DAO stream by either hydrocracking the DAO stream with a hydrocracking catalyst having a cracking base or fluid catalytic cracking (FCC), in the presence of a catalyst to produce a catalytically upgraded product;

c) slurry hydrocracking at least a portion of the asphaltene stream in the presence of hydrogen over a slurried catalyst to produce a slurry hydrocracked product; and d) recovering a product stream from said slurry hydrocracked product and deasphalting said product stream.

2. The process of claim 1 further including adding solvent to the heavy hydrocarbon feed.

3. The process of claim 2 further including separating solvent from said DAO stream to provide a solvent-lean DAO stream and recycling said solvent back to said deasphalting step.

4. The process of claim 3 further including separating solvent from said solvent-lean DAO stream to provide a DAO catalytic hydrocracking feed.

5. The process of claim 1, further comprising stripping said asphaltene stream to provide a solvent lean asphaltene stream to provide a SHC feed.

6. The process of claim 1, wherein said deasphalting step of claim 1 extracts a second DAO stream and provides a second asphaltene stream.

7. The process of claim 6, further comprising further deasphalting said second DAO stream in said deasphalting step (a) of claim 1.

8. The process of claim 1, further comprising recovering a product stream from said slurry hydrocracked product, mixing said product stream with said heavy hydrocarbon feed and deasphalting said product stream in the deasphalting step (a) of claim 1.

9. The process of claim 8, further comprising stripping said asphaltene stream to provide an asphaltene product.

10. A process for converting heavy hydrocarbons to lighter hydrocarbons comprising:

a) deasphalting a heavy hydrocarbon feed stream to extract a first DAO stream containing a greater concentration of saturated compounds than in the feed stream and provide an asphaltene stream containing a greater concentration of aromatic compounds than in the feed stream;

b) catalytically upgrading at least a portion of the first DAO stream by either hydrocracking the DAO stream with a hydrocracking catalyst having a cracking base or fluid catalytic cracking (FCC), in the presence of an upgrading catalyst to produce a catalytically upgraded product;

c) slurry hydrocracking at least a portion of the asphaltene stream in the presence of hydrogen over a slurried catalyst to produce a slurry hydrocracked product; and d) recovering a product stream from said slurry hydrocracked product and deasphalting said product stream to provide a second DAO stream.

11. The process of claim 10 further including adding solvent to the heavy hydrocarbon feed.

12. The process of claim 11 further including separating solvent from said DAO stream to provide a solvent-lean DAO stream and recycling said solvent back to said deasphalting step.

13. The process of claim 12 further including separating solvent from said solvent-lean DAO stream to provide a DAO catalytic upgrading feed.

14. The process of claim 10, further comprising stripping said asphaltene stream to provide a solvent lean asphaltene stream to provide a SHC feed.

15. The process of claim 10, further comprising deasphalting said product stream to extract a second DAO stream and provide a second asphaltene stream and further deasphalting said second DAO stream in said deasphalting step (a) of claim 10.

16. The process of claim 15, further comprising stripping said second asphaltene stream to provide a asphaltene product.

* * * * *